US005503504A

United States Patent [19]

Hess et al.

[11] Patent Number: 5,503,504

[45] Date of Patent: Apr. 2, 1996

[54] SHEETING DEVICE

[75] Inventors: Wilhelm Hess, Köln; Josef Küppers, Linnich, both of Germany

[73] Assignee: Emunds and Staudinger GmbH, Hückelshoven-Baal, Germany

[21] Appl. No.: 211,531

[22] PCT Filed: Aug. 5, 1993

[86] PCT No.: PCT/EP93/02090

§ 371 Date: May 16, 1994

§ 102(e) Date: May 16, 1994

[87] PCT Pub. No.: WO94/03683

PCT Pub. Date: Feb. 17, 1994

[30] Foreign Application Priority Data

Aug. 10, 1992 [DE] Germany ..... 42 26 405.7

[51] Int. Cl.[6] ..... E02D 5/00

[52] U.S. Cl. ..... 405/282; 405/272; 405/283

[58] Field of Search ..... 405/282, 281, 405/272, 273, 283

[56] References Cited

U.S. PATENT DOCUMENTS

| | | | |
|---|---|---|---|
| 3,530,679 | 9/1970 | Krings | 405/282 |
| 3,621,660 | 11/1971 | Krings | 405/282 |
| 4,376,599 | 3/1983 | Krings | 405/282 |
| 5,310,289 | 5/1994 | Hess | 405/282 |

FOREIGN PATENT DOCUMENTS

| | | | |
|---|---|---|---|
| 2323321 | 11/1974 | Germany | 405/282 |
| 7435632 | 2/1975 | Germany . | |
| 3117954 | 1/1982 | Germany | 405/282 |

*Primary Examiner*—Dennis L. Taylor
*Attorney, Agent, or Firm*—Cohen, Pontani, Lieberman, Pavane; Christa Hildebrand

[57] ABSTRACT

A sheeting device having large-size sheeting panels (2,4) supported against vertical supports (1,3) which are arranged in pairs facing each other and are spaced-apart by at least one spreader frame (5). The side walls (15,15') of the supports (1,3) having a C-shaped cross-section are provided with legs (16,16') which are bent in parallel to the base wall (12), are opposing each other, and leave a wide gap between them. The spreader frame (5) is guided in the supports (1,3) in a vertically movable manner. The spreader frame is provided with rollers (11,11') transmitting pressure forces and running on the base wall (12) of the supports (1,3) and with rollers (17,17') running on the inner sides of the two legs (16,16') of a support (1,3) and transmitting the traction of the spreader frame. To reduce the expenditure of material and installation work, the pressure force-transmitting rollers (11,11') and the traction force-transmitting rollers (17,17') are located on common axles (10), the pressure force-transmitting rollers (11,11') being located in the gap between the legs (16,16') of a support (1,3) and having a diameter that is larger than the distance of said legs (16,16') from the base wall (12). The rollers (17,17') transmitting the tractive forces have a smaller diameter and are located at the respective outwardly directed sides of the pressure force-transmitting rollers (11,11').

8 Claims, 2 Drawing Sheets

2
1
15
18
17
16
8
11
21
7
19
12
20
10
19'
11'
21
17'
16'
18'
15'

SHEETING DEVICE

BACKGROUND OF THE INVENTION

1. Field of the Invention

The present invention relates to a sheeting device having large-size sheeting panels arranged in pairs mutally facing each other supported against vertical supports which are positioned in pairs mutually facing each other and which are held in spaced-apart relationship by at least one spreader frame, the side walls of the supports having legs bent in parallel to the base wall, lying opposite to each other and leaving a broad gap between them, and the spreader frame in the gaps of mutually opposing supports being guided in a vertically movable manner with positive fit in the horizontal direction by means of rollers transmitting pressure forces of the spreader frame and running on the base wall of the supports and by means of rollers transmitting traction forces of the spreader frame and running on the inner sides of the two legs of a support.

Sheeting devices of this kind are known from the German Utility Model No. 74 35 632.

2. Discussion of the Prior Art

In the known sheeting devices the rollers transmitting pressure forces are located on axles positioned between the upper and the lower cross strut of the supporting frame at the left and right vertical strut of the supporting frame. The rollers transmitting tractive forces of the brace framing are located on the level of the upper and lower cross strut of the supporting frame at the right and left vertical strut of the supporting frame.

The vertically staggered arrangement of the rollers transmitting the pressure forces and those transmitting the traction forces results in high installation expenditure and greater requirements of material. In addition, arranging the pressure force-transmission rollers between the traction-transmission rollers is unfavourable since this results in the spreader frames being guided in the supports in an unsatisfactory manner.

It is the object of the present invention to provide a sheeting device ensuring a reliable guidance of the spreader frame in the supports of the sheeting device at a lower expenditure of installation work and material.

SUMMARY OF THE INVENTION

According to the present invention this object is achieved by the fact that the pressure forces-transmitting rollers and the traction forces-transmitting rollers are located on common axles, with the rollers transmitting the pressure forces being located within the gap between the legs of a support and having a diameter that is larger than the distance of said legs from the base wall of the support, and the rollers transmitting the traction forces having a smaller diameter and being located at the outwardly directed sides of the pressure forces-transmitting rollers.

The sheeting device construction according to the present invention has the advantage that only two axles, with the rollers transmitting the pressure forces and those transmitting the tractive forces arranged thereon, have to the provided at each lateral vertical strut of the expanding frame. The distance between the upper and the lower rollers of the spreader framing may be as large as possible so as to ensure an optimum guidance of the spreader framings in the supports.

Further features result from subclaims 2 to 8.

With reference to the accompanying drawings an embodiment of the present invention will be described in more detail in the following; the drawings show in FIG. 1 a side view of the sheeting device according to the present invention and FIG. 2 a view along line II—II of FIG. 1.

DESCRIPTION OF THE PREFERRED EMBODIMENTS

Figure 1:
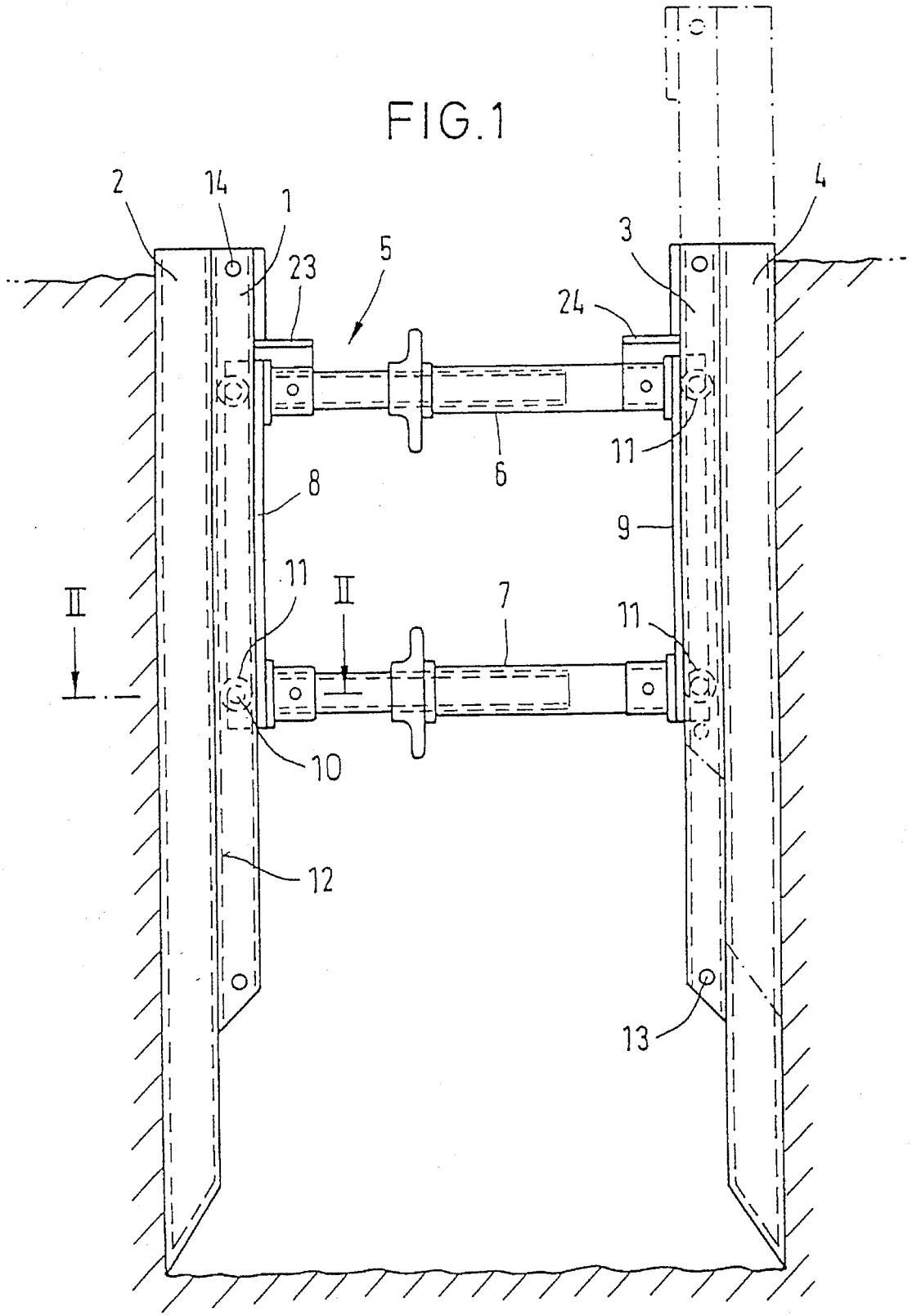

According to FIG. 1 the sheeting device for supporting the substantially vertical walls of an excavated trench consists of large-size sheeting panels 2 and 4 which are arranged in pairs mutally facing each other, these are supported by vertical supports 1 and 3 arranged in pairs opposing each other. The supports 1 and 3 of the sheeting device are spaced apart by at least one spreader frame 5. Said spreader framing 5 is built up of an upper cross strut 6, a lower cross strut 7, a left vertical strut 8, and a right vertical strut 9. Rollers 11 are located at the two vertical struts 8 and 9; by means of these rollers 11 the brace 5 is guided in the supports 1 and 3 in a vertically movable manner. At the lower and upper ends of the supports 1 and 3 stops 13 and 14 can be inserted preventing the spreader framing 5 from coming out of one of the two supports 1 and 3 unintentionally.

In the embodiment example according to FIG. 1 the upper and the lower cross strut 6 and 7 of the spreader frame 5 are formed by lengthwise adjustable braces so that the distance between the vertical struts 8 and 9 can be adjusted. When adjusting the width of the spreader frame 5, attention must be paid to the fact that the vertical struts 8 and 9 of the framework 5 run exactly parallel, or that the downward convergency does not exceed 1°. This approximate parallelism is to be kept precisely, otherwise the spreader frame 5 will get jammed in the supports 1 and 3. A slight convergency of the supports 1 and 3 does not matter that much since the spreader frame 5 can be pressed down using higher forces than are possible when it is pulled up. If there is an upward divergency of the supports, the spreader frame 5 can still be easily pulled off its guidances. At the upper ends of the vertical struts 8 and 9 of the spreader frame 5 consoles 23 and 24 are located on which a beam may be placed allowing the spreader 5 in the supports 1 and 5 to be pressed down, e.g., by means of a shovel.

Figure 2:
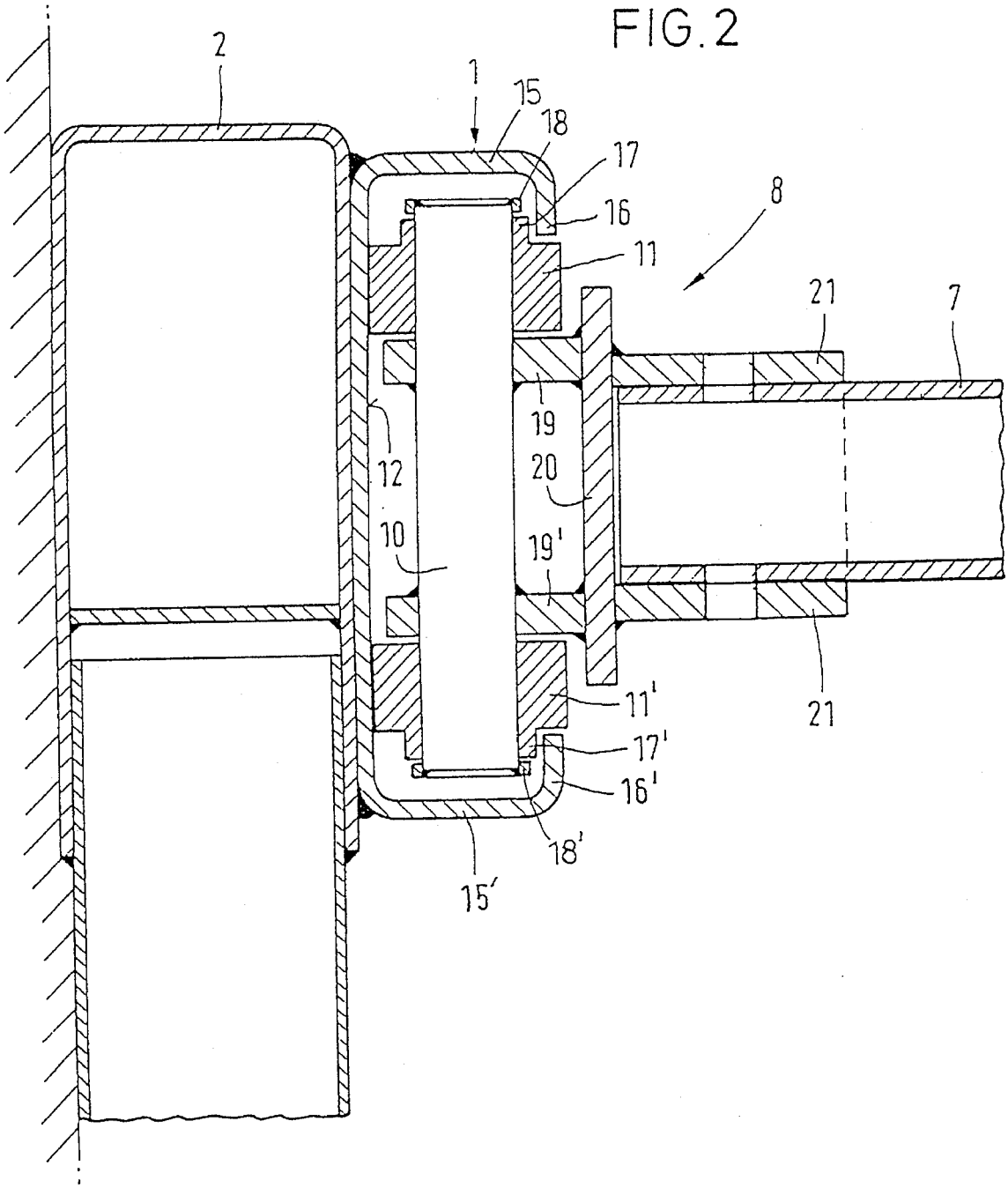

As can be seen in FIG. 2 the supports 1 and 3 have a C-shaped section. The base wall 12 of the support 1 abuts on the inner wall of the sheeting panel 2. To both lateral edges of the sheeting panel 2 a respective support 1 or 3 is attached or welded.

Side walls 15 and 15' are bent at right angles from the base wall 12 of the supporting elements 1 and 3; legs 16 and 16' are bent at right angles from said side walls 15 and 15'. The two legs 16 and 16' are opposing each other leaving a large gap through which the spreader frame 5 engages into the support 1 and 3, respectively.

As can be seen in FIG. 1 axles 10 are attached at the vertical struts 8 and 9 on a level with the upper and lower cross strut 6 and 7; rollers 11 and 11' running on the base wall 12 of the supports 1 and 3 are located on these axles.

As can be seen in FIG. 2 rollers 17 and 17' are also loacted on the axles 10, these transmit the tractive forces acting in the spreader frame 5 to the flanges 16 and 16' of the supports 1 and 3. The pressure force transmission rollers 11 and 11' have a diameter that is larger than the distance of the base wall 12 from the legs 16 and 16'. For this reason said rollers 11 and 11' transmitting pressure forces are located within the gap between the opposite legs 16 and 16' of the supports 1 and 3. The traction transmission rollers 17 and 17' have a smaller diameter and are located at the respective outwardly directed sides of the rollers 11 and 11' transmitting the pressure forces. The diameters of the rollers 11 and 17 and 11' and 17', respectively, are chosen such that in case the pressure forces-transmitting rollers 11, 11' abut on the base wall 12, the traction forces-transmitting rollers 17 and 17' have a small distance from the inner sides of the legs 16 and 16' of the supports 1 and 3.

Advantageously, each roller 11 or 11' transferring the pressure forces is connected to the respective roller 17 or 17' transferring the traction forces so as to form a single piece.

At both sides of the brace frame 5 there are two spaced-apart vertical walls 19 and 19'; the axles 10 are placed therein and welded thereto and the rollers 11, 17 and 11', 17' are pivoted on the projecting ends. To both ends of the axle 10 stop rings 18 and 18' are welded holding the rollers 11, 17 and 11', 17' on the axle 10. The base wall 12 and the support 1 or 3, respectively, is about three times as wide as one side wall 15 or 15' of a support 1 or 3. These supports are to be located at the edges of the sheeting panel so that the sheeting unit forms a so-called "edge-supported" sheeting unit. However, it is also possible to use the construction of supports and spreader framing according to the present invention for the central support of the sheeting panels.

What is claimed is:

1. A sheeting device having large-size sheeting panels arranged in pairs mutally facing each other supported against vertical supports which are positioned in pairs mutually facing each other and which are held in spaced-apart relationship by at least one spreader frame, the side walls of the supports having legs bent in parallel to the base wall, lying opposite to each other and leaving a broad gap between them, and the spreader frame in the gaps of mutually opposing supports being guided in a vertically movable manner with positive fit in the horizontal direction by means of rollers transmitting pressure forces of the spreader frame and running on the base wall of the supports and by means of rollers transmitting traction forces of the spreader frame and running on the inner sides of the two legs of a support, wherein the pressure forces-transmitting rollers and the traction forces-transmitting rollers are located on common axles, with the rollers transmitting the pressure forces being located within the gap between the legs of a support and having a diameter that is larger than the distance of said legs from the base wall, and the rollers transmitting the traction forces having a smaller diameter and being located at the respective outwardly directed sides of the pressure forces-transmitting rollers.

2. The sheeting device according to claim 1 wherein one roller transmitting pressure forces and one roller transmitting traction forces are connected with each other so as to form a single piece.

3. The sheeting device according to claim 1 characterized in both sides of the spreader frame have two spaced-apart vertical walls with the axles inserted and welded thereto and its projecting ends provided with the rollers in a pivoted manner.

4. The sheeting panel according to claim 3, wherein the base wall of a support is about three times as wide as one side wall of the support.

5. The sheeting device according to claim 4, wherein the supports are secured at the inner sides of the sheeting panels to their side walls.

6. The sheeting device according to claim 5, wherein the vertical struts of the spreader frame are connected via an upper lengthwise adjustable brace and a lower lengthwise adjustable brace to form an inherently rigid frame.

7. The sheeting device according to claim 6, wherein consoles for placing a beam thereon are located at the upper ends of the vertical struts and the outer ends of the upper spreader.

8. The sheeting device according to claim 7, wherein the axles are located on a level with the upper and lower cross struts or spreaders.

* * * * *